United States Patent [19]

Ley et al.

[11] Patent Number: 4,609,366

[45] Date of Patent: Sep. 2, 1986

[54] APPARATUS FOR THE MANUFACTURE OF PLASTIC BAGS BY WAVE-LIKE INCISION TO DEFINE HANDGRIPS

[75] Inventors: Willy Ley, Troisdorf-Spich; Günter Stasiak, Niederkassel-Rheidt, both of Fed. Rep. of Germany

[73] Assignee: Lemo M. Lehmacher & Sohn GmbH Maschinenfabrik, Niederkasel-Mondorf, Fed. Rep. of Germany

[21] Appl. No.: 658,132

[22] Filed: Oct. 5, 1984

[30] Foreign Application Priority Data

Oct. 5, 1983 [DE] Fed. Rep. of Germany ..... 3336145

[51] Int. Cl.[4] ..... B31B 1/18; B31B 1/86; B31B 19/02

[52] U.S. Cl. ..... 493/22; 493/197; 493/227; 493/372; 493/926; 83/428

[58] Field of Search ..... 493/22, 196, 197, 203, 493/209, 226, 227, 372, 926; 83/428

[56] References Cited

U.S. PATENT DOCUMENTS

| | | | |
|---|---|---|---|
| 157,815 | 12/1874 | Hall | 83/428 |
| 204,145 | 5/1878 | Ford et al. | 83/487 |
| 449,057 | 3/1891 | Perkins | 83/428 |
| 3,066,394 | 12/1962 | Litzka | 83/428 |
| 3,183,750 | 5/1965 | Davis, Jr. et al. | 493/372 |
| 3,797,345 | 3/1974 | Allen | 83/175 |
| 4,174,657 | 11/1979 | Suominen | 493/197 |
| 4,398,903 | 8/1983 | Lemacher | 493/197 |

*Primary Examiner*—Francis S. Husar
*Assistant Examiner*—William E. Terrell
*Attorney, Agent, or Firm*—Karl F. Ross; Herbert Dubno

[57] ABSTRACT

An apparatus for making plastic handle bags from an advancing flat tubular web includes a knife supported above the moving web and reciprocated transversely by a cam roller to produce a sinusoidal-wave-like cut longitudinally of the web. A support guide having a slot at least as wide as the wave amplitude is positioned beneath the web so that in the event of an interruption of feed the guide lowers, withdrawing the web from the knife, which continues to reciprocate, thereby avoiding start-up inertial friction or chatter. Downstream of the cutting station a detour assembly phase shifts one of the half-tubes 180° to align the transversely extending bag edges for heat sealing. The cutting support assembly is longitudinally movable of the web.

2 Claims, 5 Drawing Figures

APPARATUS FOR THE MANUFACTURE OF PLASTIC BAGS BY WAVE-LIKE INCISION TO DEFINE HANDGRIPS

FIELD OF THE INVENTION

Our present invention relates to an apparatus or machine for making plastic bags.

BACKGROUND OF THE INVENTION

The manufacture of plastic bags from a flattened, tubular web movable in a production direction with a machine having input rollers, output rollers, a cutting device and a transverse bag welding device is known.

The cutting device can produce a wavelike cut in the flattened, tubular web running in the web-feed direction. This wavelike cut can define two halves or web sections which have complementary upper hand grips.

Between the cutting device and the transverse bag-welding device a detour device is positioned which causes a phase shift in the web sections with respect to the wavelike cut when one of the web sections is passed through the detour device.

The detour apparatus thus positions the bag hand grips over one another. The phase-shifted web sections are jointly fed into the transverse bag-welding apparatus to close the sides of the plastic bags. The cutting apparatus has a knife as well as a knife control roller with a cutting knife groove therein and the cutting knife is held in a cutting groove over which the flattened, tubular strip is fed.

In such an apparatus, e.g. as described in German Patent DE-OS No. 30 04 220, corresponding to U.S. Pat. No. 4,398,903, the flattened tubular web is fed over a roller which extends across the entire width of the tubular web.

The web is typically synchronized with the roller systems and bears a cut or incision which when examined appears more or less sinusoidal. The rollers flank the tubular web.

The cutting knife control roller is constructed to come near those rollers, carries the knife control groove and holds a conforming structure in the knife groove.

The cutting knife control groove and the knife cutting groove are formed with great precision so that on operation the cut previously mentioned is satisfactory and is free from chatter marks and the like. To allow the stacking of the manufactured plastic bags, the feed of the strip may be temporarily interrupted by frequent unavoidable idle periods so that a basic inertia problem arises on renewed running.

It is thus possible that the cut in the strip will not be uniform with renewed running but will show an almost continuous set of faults.

OBJECT OF THE INVENTION

The object of the invention is to simplify this kind of apparatus from a mechanical point of view and, at the same time, to improve its operation.

SUMMARY OF THE INVENTION

This object is attained in accordance with the invention in that the flattened tubular web is inputted or fed over a solid grooved guide provided with a cut groove is positioned which has a width substantially equal to the amplitude of the previously mentioned wavelike cut.

The cutting knife control roller is positioned between solid support elements near and before and/or over the cutting groove.

The supporting elements support a guide rod, and a knife carriage is slidably mounted on the guide rod, the knife carriage having on one side a control pin which engages the cutting knife control apparatus and on the other side the cutting knife.

According to the preferred embodiment of the invention the control roller has a drive which is operated as a cyclic drive and works permanently, while the operation of the input and output rollers is haltable during the idle period of the machine's function. With the input and output rollers halted, the grooved guide can be lowered so as to remove the cutting knife from engagement with the foil strip. This avoids the previously described stored inertia that can occur in the prior art apparatuses during start up after an idle period. For purposes of adjustment of the cutting action on the transport of the strip, the grooved guide and the control roller (the latter with the help of the cyclic drive) are mounted in a stand which is slidable back and forth in the motion direction of the strip.

An advantage of these structures is that the apparatus according to the invention is significantly simplified in regard to its mechanical structure. Specifically in the apparatus of the invention a driven feed roller having a cutting knife control groove and a cutting groove on opposite sides is no longer necessary. The strip will be fed over a grooved guide which can indeed be raised and lowered but is however otherwise fixed and nonrotatable. Consequently the cutting knife control roller can be continually driven to eliminate the inertia problem after an idle period of the apparatus.

SPECIFIC DESCRIPTION

Figure 1:
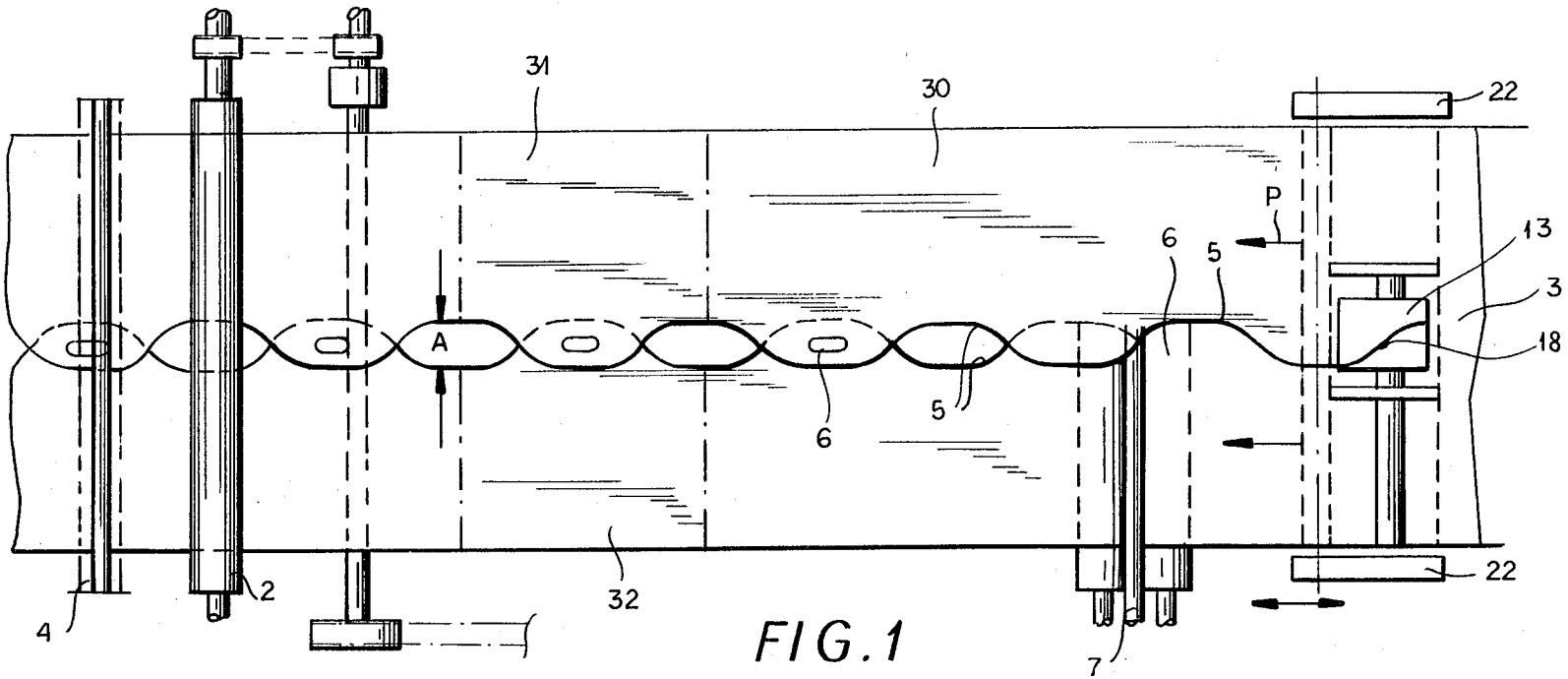
FIG. 1 is a top plan view of the apparatus according to the invention.

The apparatus shown in the drawing is for the manufacture of plastic bags from a flattened tubular web 30 movable continuously or intermittently in the production direction P. The tubular strip can be provided with a bottom fold on the margin of its long edge. The following basic construction is used for the apparatus: Input feed rollers 1 (FIG. 2); output feed rollers 2; a cutting apparatus 3 (FIG. 1) and a transverse welding apparatus 4.

Figure 2:
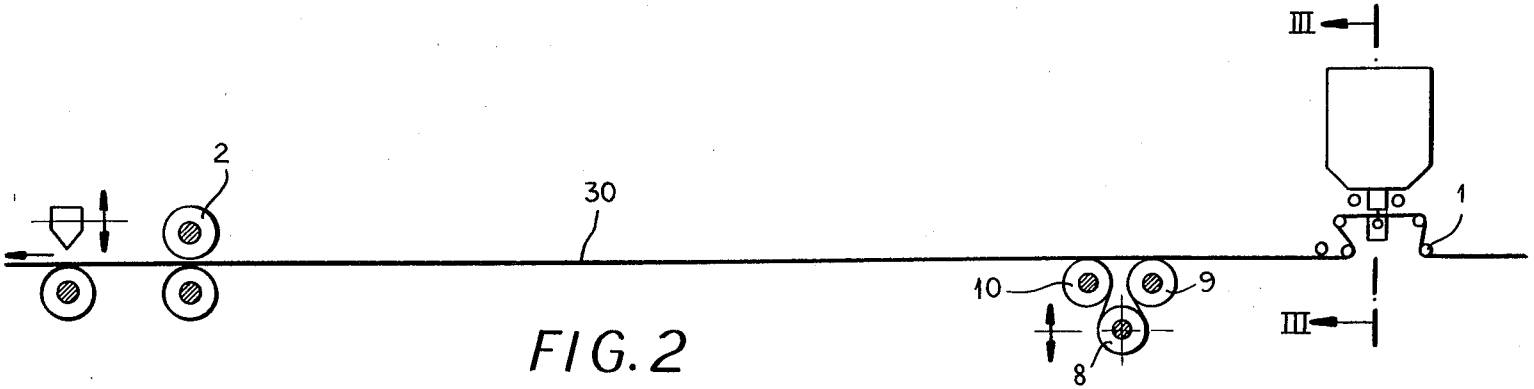
FIG. 2 is a side view of the embodiment shown in FIG. 1.

The cutting apparatus 3 is positioned so as to produce a wavelike cut 5 of amplitude A as shown in FIG. 1. FIG. 1 also shows that the cut 5 outlines upper bag handgrips 6 and subdivides the web into web sections 31 and 32 are defined by the incision 5.

Between the cutting apparatus 3 and the transverse bag welding apparatus 4 there a detour apparatus 7 which causes a phase shift between the sections 31 and 32 with respect to the wavelike cut 5.

The phase shift is such that the hand grips 6 are positioned above one another as shown in FIG. 1.

The detour apparatus 7 works with guide rollers 8, 9, and 10 to cause a U-shaped detour in the path of one of the web sections 31 and 32. The U-shift in the path introduces the phase shift by an adjustable upward and downward positioning of the aforementioned guide roller 8. The phase-shifted web sections 31 and 32 are then introduced jointly to the transverse bag welding apparatus 4.

Figure 3:
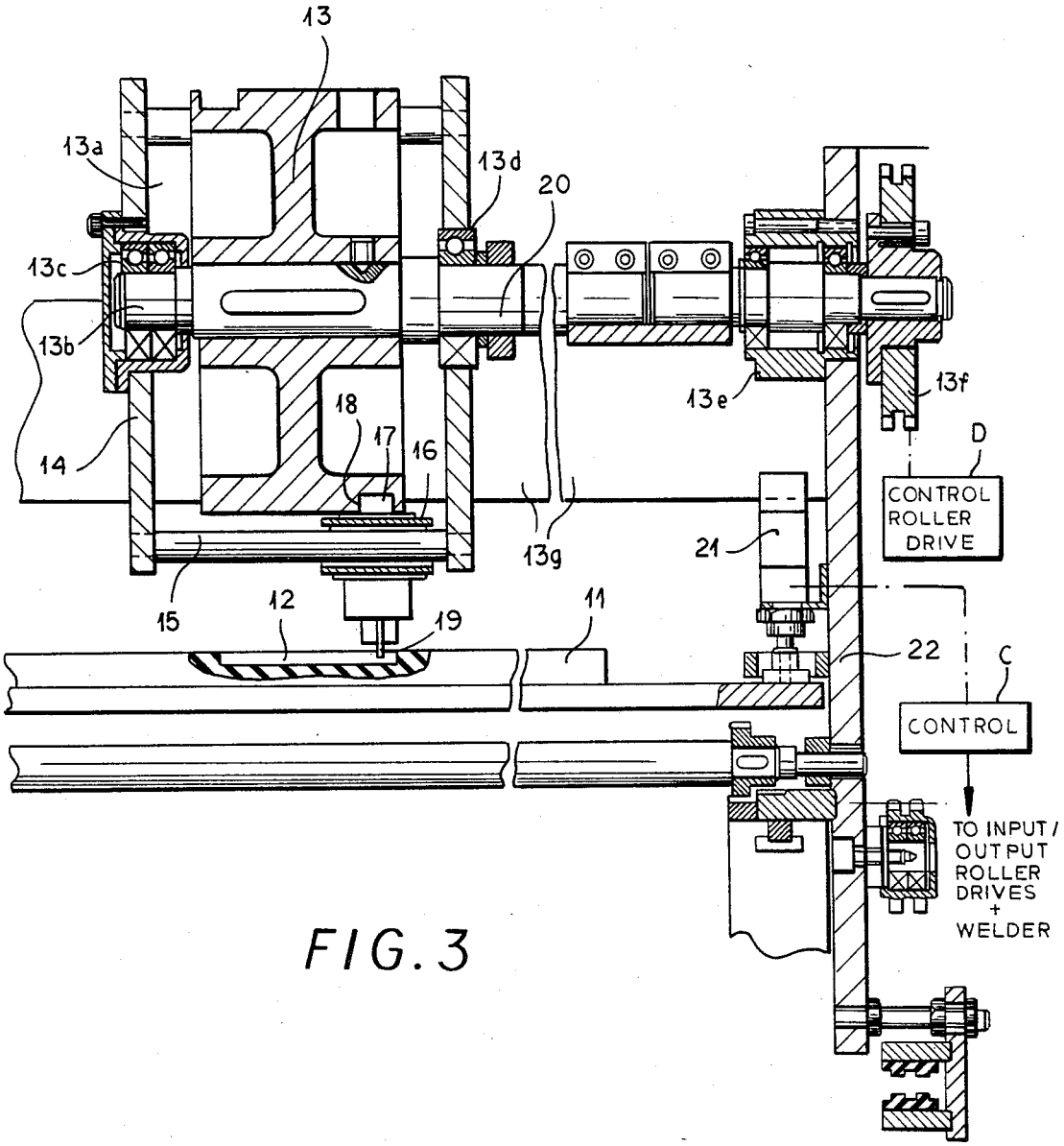
FIG. 3 is a sectional view along the line III—III through the apparatus according to FIG. 2 drawn to a larger scale.
Figure 4:
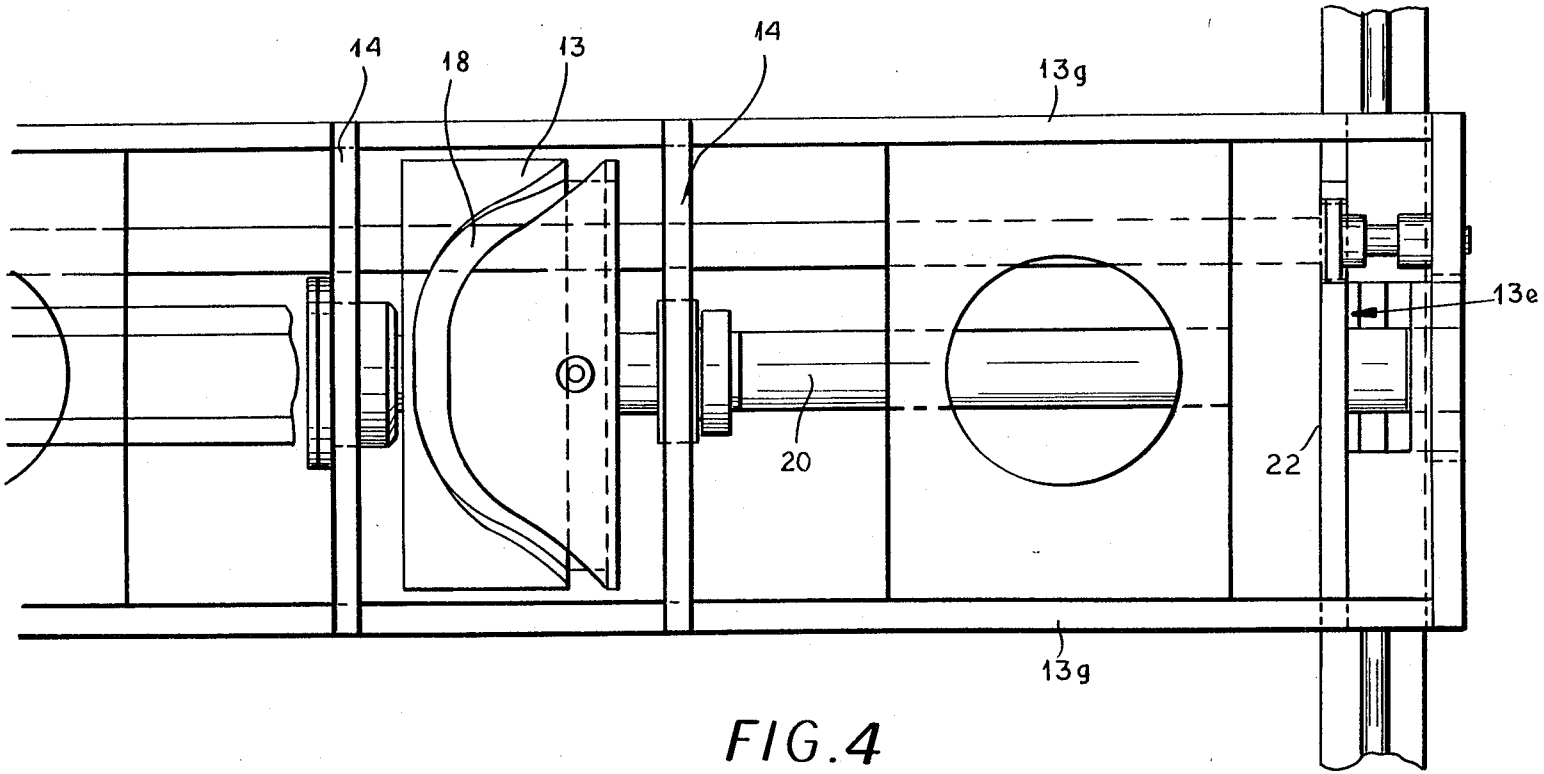
FIG. 4 is a top plan view of the apparatus seen in FIG. 3.
Figure 5:
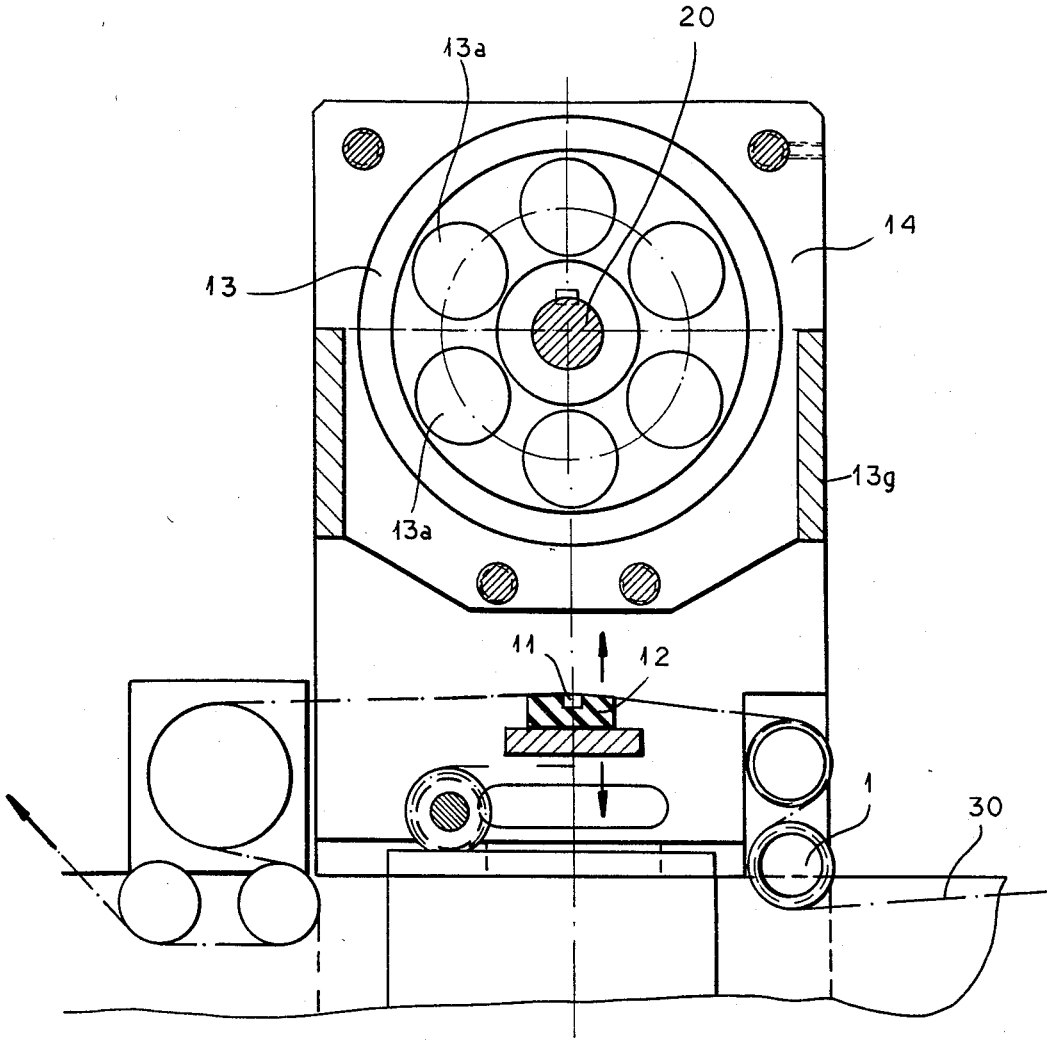
FIG. 5 is a partially-sectional side view of the apparatus of FIG. 3.

Particularly it can be seen from FIGS. 3 to 5 that the web 30 is fed over a grooved guide 11 in which a cutting groove 12 is formed of a width that conforms to the amplitude A of the wavelike cut 5.

A cutting knife control roller 13 is mounted between stationary support elements 14 in position before or, as in the embodiment illustrated, above the cutting groove 12. The support elements 14 support the guide bar 15. on the guide bar 15 a cutting knife carriage 16 is slidably mounted. The carriage has on one side a control pin 17 engaging in a cutting knife control groove 18 in control roller 13 and on the other side the cutting knife 19.

The control roller 13 engages a cutting knife drive D which works continuously and which engages the drive shaft 20 of the control roller 13, although the input rollers 1 and the output rollers 2 are totally haltable during the idle period of the apparatus.

The control roller 13 is keyed to a shaft **13*b* journaled in bearings 13*c*, 13*d* in supports 14 for the bar 15 carrying the knife carriage 16 and has cavities 13*a* best seen in FIGS. 3 and 5. The supports 14 are mounted in a frame part of which has been shown at 13*g*, connected to the support structure 22 in which the shaft 20 is journaled at 13*e* and driven at 13*f* by a continuous control roller drive represented diagrammatically at D. The controller C operates the input and roller drive, the welder and the piston-cylinder units 21 so that upon temporary halting of the feed of the web, e.g. to allow stacking of bags produced, the grooved plate 11 will be dropped to remove the web from the path of the continuously displaced blade 19**.

The grooved guide 11 is lowerable, when the input and output rollers 1 and 2 respectively are halted by the controller C by means of the cylinder-piston unit 21. In this lowered configuration the strip 30 is disengaged from the working cutting knife 19.

The double-headed arrow in FIG. 1 indicates that the grooved guide 11 and the control roller 13 are positioned in support housing 22 so as to be shiftable therewith back and forth in the direction of the motion of the strip.

We claim:

1. In an apparatus for making plastic bags in which a flattened tubular web is displaced past an incising station in which a wave-like incision subdivides said web longitudinally into two sections and said sections are then offset from one another to allow the alignment of handgrip portions defined by said incision before said sections are welded to form a succession of bags, the improvement which comprises in combination:

feeding means advancing said web in a longitudinal path horizontally past said station;

a grooved guide disposed beneath said web path at said station and formed with a groove having a width transversely of said web path at least equal to an amplitude of the wave-like pattern of said incision;

a knife carriage displaceable transversely of aid web path above said web path and having means comprising a knife extending downwardly toward said grooved guide for forming said incision when said blade extends into the groove of said grooved guide and said web is advanced past said station and said knife;

a bar extending transversely of said web path and carrying said carriage slidably along said bar;

a roller mounted above said bar and formed with an endless means engaging said carriage for shifting same back and forth along said bar with rotation of said roller;

roller drive means operatively connected with said roller for continuously rotating said roller to displace said carriage continuously even upon interruption of the advance of said web past said station;

feed drive means connected to said feeding means for operating said feeding means such that the web advance can be interrupted from time-to-time; and means supporting said grooved guide for lowering same upon interruption of the advance of said web to withdraw said knife from said groove of said grooved guide, and for raising said grooved guide to enable said knife to project into the groove of said grooved guide upon restoration of advance of said web.

2. The improvement defined in claim 1 wherein said bar, said roller and said carriage are mounted on a common support adapted to be displaced in the direction of advance of said web.

* * * * *